United States Patent [19]

Humphreys

[11] 4,139,209

[45] Feb. 13, 1979

[54] ADJUSTABLE SHOE-SKATE ASSEMBLY

[76] Inventor: Donald R. Humphreys, 11 Pequot Rd., Marblehead, Mass. 01945

[21] Appl. No.: 858,733

[22] Filed: Dec. 8, 1977

[51] Int. Cl.[2] ..... A63C 1/30

[52] U.S. Cl. ..... 280/11.12

[58] Field of Search ..... 280/11.12, 11.18, 11.17, 280/11.16, 11.15, 11.14, 7.13

[56] References Cited

U.S. PATENT DOCUMENTS

| | | | |
|---|---|---|---|
| 1,454 | 4/1863 | Gregory | 280/11.12 |
| 39,149 | 7/1863 | Johnson | 280/11.12 |
| 601,013 | 3/1898 | Evans | 280/11.12 |
| 1,097,875 | 5/1914 | Pierce | 280/11.12 |
| 3,212,786 | 2/1963 | Florjancic et al. | 280/11.12 |
| 4,074,909 | 2/1978 | Baikie | 280/11.12 |

*Primary Examiner*—Joseph F. Peters, Jr.
*Assistant Examiner*—Milton L. Smith
*Attorney, Agent, or Firm*—Carl E. Johnson

[57] ABSTRACT

A skate blade carrier integral with or attached to a shoe bottom has a heel support portion, a forepart support portion, and a strut section interconnecting the support portions. The base of the carrier has a longitudinal kerf for partly receiving the blade. Means secured to the carrier is adapted to adjustably tilt the blade about an axis extending widthwise of the shoe beneath its heel and to selectively shift a skater's locality of balance on the blade along its exposed edge.

12 Claims, 4 Drawing Figures

10
12
14
15
16
18
20
22
24
26
28
30
32
34
36
38
40
42
44
46
48
50
52
54
56
58
X
P
T
S
II
II 12
20
22
30
32
34
36
38
40
X 10
14
20
22
26
42
44
46
48
50
52
54
58

10
14
18
20
22
24
26
42
44
46
48
54

ADJUSTABLE SHOE-SKATE ASSEMBLY

BACKGROUND OF THE INVENTION

Ice skating has become a widely popular form of recreation and is often enjoyed in all seasons of a year. For many skaters the so-called "shoe-skate", i.e. the combination of a shoe having a rigid metal blade carrier permanently attached, has greatly improved their confidence and skill in maneuvering on ice whether engaged in sports, figure skating or simply as a pleasurable activity.

By way of perfecting shoe-skates better to satisfy the individual preferences of skaters, mechanism has been provided for modifying the ice-engaging contour of skate blades. This has involved not only sharpening of the blade runner or edge but the removal of blade metal to retain or modify edge contour as required. In U.S. Pat. No. 3,789,551 granted in my name and that of John F. Norris, for instance, there is disclosed a widely used mechanism for custom grinding skate blades, an object being to establish a new or maintain an old desired locality of balance along the blade for each skate of a pair. Unfortunately all such prior practices, so far as known, have necessitated some removal of the metal of the blade. Also, it previously has generally been impractical if not impossible to interchange one blade for another of a shoe skate.

SUMMARY OF THE INVENTION

In view of the foregoing it is a main object of this invention to provide an improved shoe-skate assembly incorporating simple means for adjustably tilting a skate blade about an axis extending widthwise of the shoe.

A further object of the invention is to provide a shoe skate with an improved, adjustable blade carrying means whereby a skater may, without removal of metal from his skate blade, establish or shift his preferred locality of balancing along the blade edge.

Yet another object of the invention is to provide a novel skate blade carrier assembly for facilitating interchangeability of ice skate blades, and for modifying their longitudinal balance point regardless of the contour of this ice-engaging edge.

To these ends, and as herein shown, a novel skate blade carrier integral with or attached to the bottom of a boot or shoe has a heel support portion, a forepart support portion, and a strut section interconnecting these support portions. The carrier, which may be of metal or molded plastic, is formed with a longitudinal kerf substantially the same width as the blade to be at least partly received therein for adjustable heightwise positioning relative to the carrier. Preferably fastener means connect the blade to the mentioned heel and forepart portions, respectively, whereby the blade may be adjustably pivoted as desired about a widthwise axis extending through the heel end of the blade. The fastener means, moreover, may be interchangeable to simplify replacement of parts as well as render adjustment of the assembly convenient for children as well as adults. A gauge or scale is desirably provided for enabling read-out of relative blade inclination.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF PREFERRED EMBODIMENT

Figure 1:
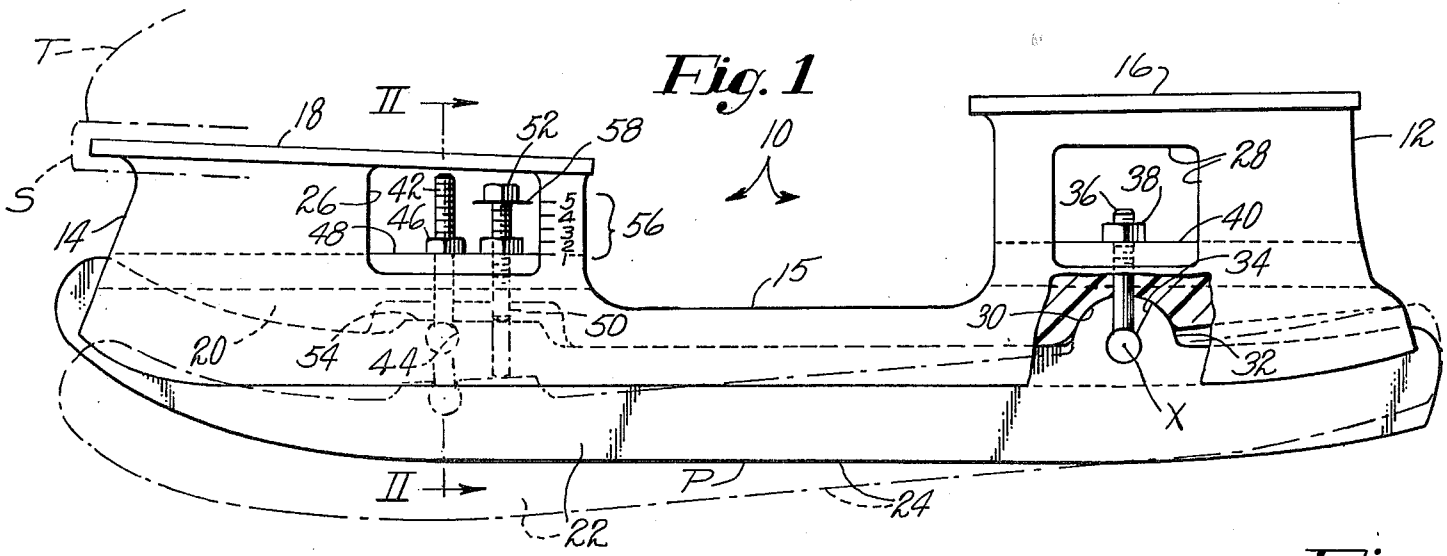
FIG. 1 is a view in side elevation of a shoe-skate assembly comprising a skate blade carrier, a skate blade, and fastener means for adjustably positioning the blade to longitudinally establish a skater's balance point along the blade.

Referring to FIG. 1, a skate blade carrier generally designated 10 comprises a heel support portion 12, a forepart support portion 14, and a strut section 15 interconnecting the support portion 12, 14. These portions, by means not herein shown, may have their horizontal platforms 16,18, respectively, permanently secured to the bottoms of hockey boots or other types of conventional footwear, or alternatively may become an integral part of a boot or shoe, the bottom of which, for instance, is a molded-on sole S. In FIG. 1 only a toe portion T of the upper of such a shoe is indicated along with a portion of the molded sole S enveloping at least a part of the platform 18.

It will be understood that the carrier 10 may be of metal or it may be of a high impact plastic.

It will further be appreciated that the carrier 10, herein illustrated (note FIG. 2) as having its lower or base portions of a roughly W-shaped configuration in transverse section, may in fact be provided in any desired, substantially rigid contour affording suitable balance, strength, and preferably devoid of snags or objectionable protrusions.

As shown in the several views, the base of the carrier 10 is longitudinally formed with a central kerf 20 having a width substantially that of the upper section of an ice skate blade 22 movably received therein. A lower or runner edge 24 of the inserted blade remains exposed for engagement with ice or other suitable skating surface. A transverse opening defined by walls 26 is formed in the forepart portion 14, and a transverse opening defined by wall 28 is formed in the heel portion 12, both openings providing access for fingers or simple tools (not shown) for operating hardware or fasteners enabling the blade 22 to be adjustably secured by tension to the carrier 10, for instance as will next be described. If preferred the openings 26,28 or either of them may be accessible from a single side only.

Figure 4:
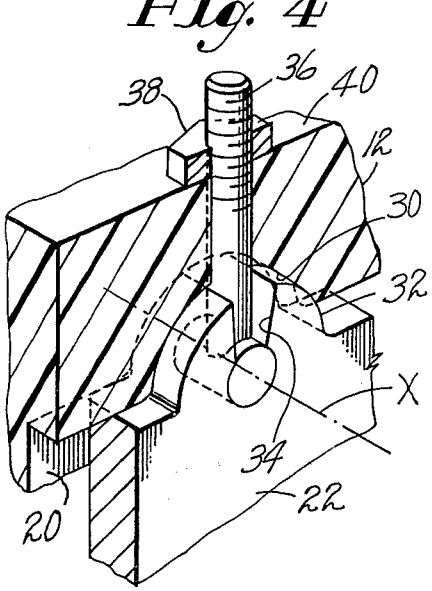
FIG. 4 is a detail view in perspective showing the heel part suspension of the blade and its axis.

The heel end of the carrier is formed with a semi-circular bearing socket 30 (FIGS. 1,4) for accommodating a corresponding upper portion 32 of the blade. The portion 32 has a tapering opening 34 leading downwardly to a cylindrical bearing slot for rotatably receiving the head of a T-screw or pivot stud 36. A threaded shank of the stud 36 extends freely through a vertical bore in the heel portion 12 which may have a transverse section largely corresponding to that shown in FIG. 2. As will be apparent, when the head of the pivot stud 36 is fitted in the blade, and the upper end of the shank extends upwardly in the portion 12 to be accessible through the opening 28, a nut 38 may be threaded onto or off the shank. Upon tightening of the nut to tension the pivot stud between its bearing slot and an internal surface 40 of the portion 12, a pivot axis X (FIGS. 1,4) extending widthwise of the assembly is determined for the blade 22. The latter is thus constrained against tilt relative to the carrier about a longitudinal axis by the kerf 20 and the fastener means.

Figure 3:
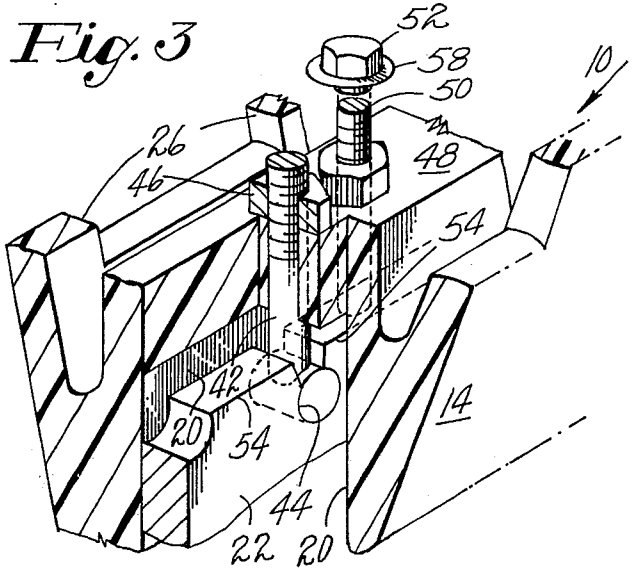
FIG. 3 is a vertical broken section through the forepart of the carrier showing details of the fastener means illustrated in FIGS. 1 and 2.
Figure 2:
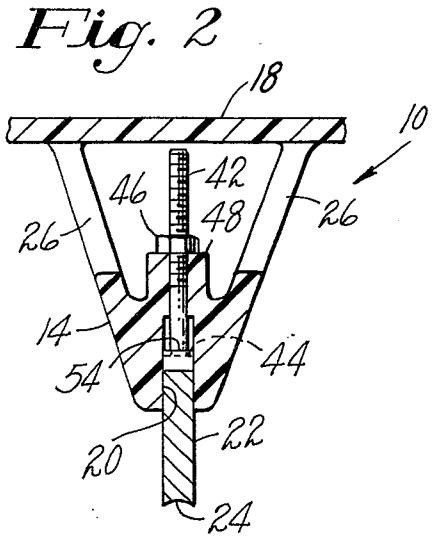
FIG. 2 is a section taken along the line II—II of FIG. 1.

The forepart 14 of the carrier 10, as indicated herein in FIGS. 1–3, is also vertically bored freely to receive fastener means, for insance, the shank of a pivot stud 42, the cylindrical head of which is rotatably received in a correspondingly shaped bearing 44 in the blade 22. A nut 46 adjustably threaded on the pivot stud 42 and abutting an internal raised surface 48 of the carrier is accordingly able to angularly adjust the blade about the axis X, the nut being accessible through the opening 26. A bolt 50 (FIGS. 1,3) adjustably threaded vertically in the portion 14 and having its head 52 also accessible is arranged to abut endwise a rise 54 on the inner edge of the blade thus to fix the selected heightwise or angular relation of the blade 22 to the carrier 10 when the nut 46 has been tensioned. Preferably indicia such as a scale 56 (FIG. 1) is provided on the carrier, a flange 58 of the head 52 serving as an indicator and providing read-out when its heightwise position is compared to units of the scale 56.

The blade 22 shown is representative, of course, of many different possible sizes and shapes which may be used interchangeably with a given carrier 10 assuming longitudinal spacing and formation of the heel and forepart blade bearing slots are constant. Also, it will in some cases be invertible in the kerf 20 for protection of the runner edge 24 during non-use of the skate.

Briefly to review usage of the shoe skate assembly, it will be assumed that the carrier platforms 16,18 are suitably attached to a shoe bottom, and that it is desired to alter the position of a longitudinal point P (FIG. 1) for a skater along the blade edge 24. If this point is to be shifted toeward, the bolt 50 will be rotated, as by a small wrench inserted into the opening 26, to lower the bolt flange 58 from its "5" position on the scale 56 to, for instance, the "1" position indicated by dash line, thus pivoting the blade 22 counterclockwise, as seen in FIG. 1 about the axis X. The nut 46 is then screwed further downwardly on the stud 42 to again abut the surface 48 and suspend the blade 22 in endwise engagement with the bolt 50 in its lowered position.

The skate blade assembly is readily disassembled by unthreading the two nuts from their pivot studs whereupon the blade 22 and the studs can be separated from the carrier 10. If desired the studs can then be removed from their blade bearing slots. Remounting of the same or a different blade 22 by reversal of these steps is a convenient and easy procedure.

It will be understood from the foregoing that the invention provides a skate blade assembly whereby a skater's longitudinal balance point may be readily selected. Moreover, his blade is interchangeably held in a secure manner in any of its adjusted positions. Clearly the shape and particular materials of the carrier 10, as well as the particular fastener means employed for developing and holding the desired blade 22 in tension and at an adjustable angle relative to the carrier, may be changed considerably without departing from the scope of this invention as set forth in the following claims.

I claim:

1. An assembly for adjustably mounting a skate blade to a boot or shoe comprising a carrier, the carrier including a heel support portion, a forepart support portion, and a longitudinal strut for interconnecting said heel and forepart portions, the carrier being formed with a longitudinal kerf having a width substantially that of the blade for movably receiving an upper part of the blade while a lower part thereof remains exposed, means associated with the heel support portion for holding the blade for pivotal movement about an axis extending widthwise of the blade, and means associated with the forepart support portion for suspending the blade for adjustable angular movement about said axis.

2. An assembly as in claim 1 wherein the carrier is of high impact plastic.

3. An assembly as in claim 1 wherein said means associated, respectively, with the heel and forepart support portions comprises a threaded fastener and nut.

4. An assembly as in claim 3 wherein the fastener is a pivot stud having a head detachably mounted in the blade for movably suspending it in the kerf.

5. An assembly as in claim 1 wherein said heel and forepart support portions are respectively formed with an upper plate-like portion adapted to be secured to the bottom of the boot or shoe, and opposite sides of each of the plate-like portions are supported by integral, widthwise spaced struts convergent toward the blade.

6. An assembly as in claim 5 wherein at least a part of the carrier plate-like portions are embedded in a molded-on sole of the boot or shoe.

7. An assembly as in claim 5 wherein the heel and forepart support portions are substantially W-shaped in cross section, said blade holding and suspending means extending vertically in the mid portion of said cross sections.

8. An assembly for longitudinally establishing a skater's balance point along an ice skate blade comprising a blade, a blade carrier to be mounted on a shoe bottom and formed with a kerf for closely receiving a portion of the blade, the kerf being substantially of the same length as the blade and of less height, fastener means in the heel end of the carrier for pivotally supporting the blade for movement about an axis extending widthwise through the heel end of the blade and across said kerf, and other means movably secured in the forepart of the carrier and connected to the forepart of the blade for adjusting it angularly about said axis.

9. An assembly as in claim 8 wherein the blade is formed at longitudinally spaced localities with socket bearing formations adapted to cooperate with said fastener means and said other means respectively.

10. An assembly as in claim 8 wherein said other means comprises a stud and a nut threaded thereon for adjustably urging the forepart of the blade heightwise of said kerf, and an abutment for limiting such movement of the blade.

11. An assembly as in claim 10 wherein a scale is provided on the carrier forepart for enabling read-out of the angular blade adjustment selected.

12. An assembly as in claim 11 wherein a scale on the carrier in relation to heightwise position of said abutment enables read-out of the blade angular adjustment.

* * * * *